US008041254B2

(12) United States Patent
Ito

(10) Patent No.: US 8,041,254 B2
(45) Date of Patent: Oct. 18, 2011

(54) IMAGE FORMING APPARATUS MEDIUM GUIDE CONFIGURATION AND METHOD

(75) Inventor: Sakae Ito, Kitanagoya (JP)

(73) Assignee: Brother Kogyo Kabushiki Kaisha, Aichi-ken ( * ) Notice: Subject to any disclaimer, the term of this patent is extended or adjusted under 35 U.S.C. 154(b) by 387 days.

(21) Appl. No.: 12/204,754

(22) Filed: Sep. 4, 2008

(65) Prior Publication Data

US 2009/0060573 A1 Mar. 5, 2009

(30) Foreign Application Priority Data

Sep. 5, 2007 (JP) ..... 2007-230411

(51) Int. Cl.
*G03G 15/00* (2006.01)

(52) U.S. Cl. ..... 399/110; 399/122; 399/124

(58) Field of Classification Search ..... 399/110, 399/122, 124
See application file for complete search history.

(56) References Cited

U.S. PATENT DOCUMENTS

| | | | | |
|---|---|---|---|---|
| 7,555,239 | B2 | 6/2009 | Ito | |
| 2006/0008294 | A1* | 1/2006 | Ito et al. | 399/122 |
| 2006/0083542 | A1* | 4/2006 | Ito | 399/107 |
| 2007/0001368 | A1 | 1/2007 | Ueyama | |
| 2009/0022515 | A1 | 1/2009 | Ito | |

FOREIGN PATENT DOCUMENTS

| | | |
|---|---|---|
| JP | 200653508 | 2/2006 |
| JP | 2006335489 | 12/2006 |
| JP | 2007017488 | 1/2007 |

OTHER PUBLICATIONS

JP Office Action, Appln. No. 2007-230411, mail date Aug. 18, 2009.
JP Notice of Reasons for Rejection, Appeal No. Appeal 2010-005154, Appln. No. 2007-230411, mail date Nov. 9, 2010 (original JP language and translation of claims and reasons of rejection).

* cited by examiner

*Primary Examiner* — David Gray
*Assistant Examiner* — G. M. Hyder
(74) *Attorney, Agent, or Firm* — Banner & Witcoff, Ltd.

(57) ABSTRACT

An image forming apparatus may include a sheet conveyance path having a generally U-shaped portion. The U-shaped portion may be formed by inner and outer guides, and the guides may be arranged such that they may be sequentially removed from the apparatus in a common direction, and through a common opening in the apparatus. For example, to remove a fixing portion from within the apparatus, the outer guide may first be removed, followed by the removal of the inner guide, and then followed by the removal of the fixing portion. The guides may overlap one another when viewed from the common direction.

10 Claims, 12 Drawing Sheets

IMAGE FORMING APPARATUS MEDIUM GUIDE CONFIGURATION AND METHOD

CROSS REFERENCE TO RELATED APPLICATION

This application claims priority from Japanese Patent Application No. 2007-230411, filed on Sep. 5, 2007, the entire subject matter of which is incorporated herein by reference.

FIELD

Features described herein relate to electrophotographic image forming apparatuses configured to form an image on a recording sheet by transferring a developer image on the recording sheet.

BACKGROUND

A known electrophotographic image forming apparatus includes a fixing unit that is configured to fix a developer image onto a recording sheet, such as a plain, glossy, and transparent sheet, by heat.

In a small-sized image forming apparatus in connection with an information processing device, such as a personal computer, a recording sheet ejected from the fixing unit is turned upward about 180 degrees and ejected onto a sheet ejection tray disposed above the fixing unit.

A path for conveying a recording sheet (hereinafter referred to as a conveyance path) has generally a U-shape from the fixing unit to the sheet ejection tray. The conveyance path is defined by an inner guide forming an inner guide surface of the U-shaped conveyance path and an outer guide disposed facing the inner guide and forming an outer guide surface of the conveyance path.

In the above image forming apparatus, the inner guide and a part of the ejection tray are integrally formed into a tray member, which is configured to be attached to and removed from the ejection tray. With this configuration, the image forming apparatus can be reduced in height while improving the removability of the fixing device.

For a low-profile image forming apparatus, if the lower end of the sheet ejection tray is lowered further than the upper end of the fixing device, the fixing device may interfere with the lower end of the sheet ejection tray when horizontally attached to or removed from the rear of the image forming apparatus.

As described above, the U-shaped conveyance path continuing from the fixing unit to the sheet ejection tray may be defined by the inner guide forming the inner guide surface of the conveyance path and the outer guide disposed facing the inner guide and forming an outer guide surface of the conveyance path. When viewed from the rear side of the image forming apparatus, that is, in a direction where the fixing device is attached to and removed from the image forming apparatus, the outer guide overlaps a part of the inner guide.

Thus, when the inner guide is moved horizontally, the outer guide may interfere with this movement. When the inner guide is attached to or removed from the image forming apparatus, the inner guide and the outer guide may be highly damaged on their respective guide surfaces.

When the inner guide is attached to or removed from the image forming apparatus, the inner guide needs to be moved obliquely and horizontally so as to prevent the inner guide from interfering with the outer guide. This may complicate attaching or removing the inner guide and the fixing unit to or from the image forming apparatus.

The guide surfaces of the inner guide and the outer guide are configured to guide a recording sheet in sliding contact therewith. If the guide surfaces are damaged, it is difficult to convey the recording sheet smoothly, which may lead to problems such as jamming.

SUMMARY

Aspects described herein provide an image forming apparatus configured to improve an operation to attach and remove an inner guide and a fixing device thereto and therefrom.

In one aspect, the inner and outer guides may be individually removable in a common direction, such as by movement towards the rear of the apparatus. A fixing device may also be separately removed in the same direction, although the fixing device may be integrally formed with the inner guide. The outer guide, inner guide and fixing device may all be removed through the same opening in the main body of a printing apparatus. In some aspects, the inner guide may be integrally formed with the fixing device.

The inner and outer guides may oppose one another, and form a generally U-shaped sheet conveyance path. Viewed from a common direction, such as from the rear of the device, the guides may be seen as overlapping one another.

BRIEF DESCRIPTION OF THE DRAWINGS

Illustrative features will be described in detail with reference to the following figures in which like elements are labeled with like numbers and in which.

DETAILED DESCRIPTION

Figure 1:
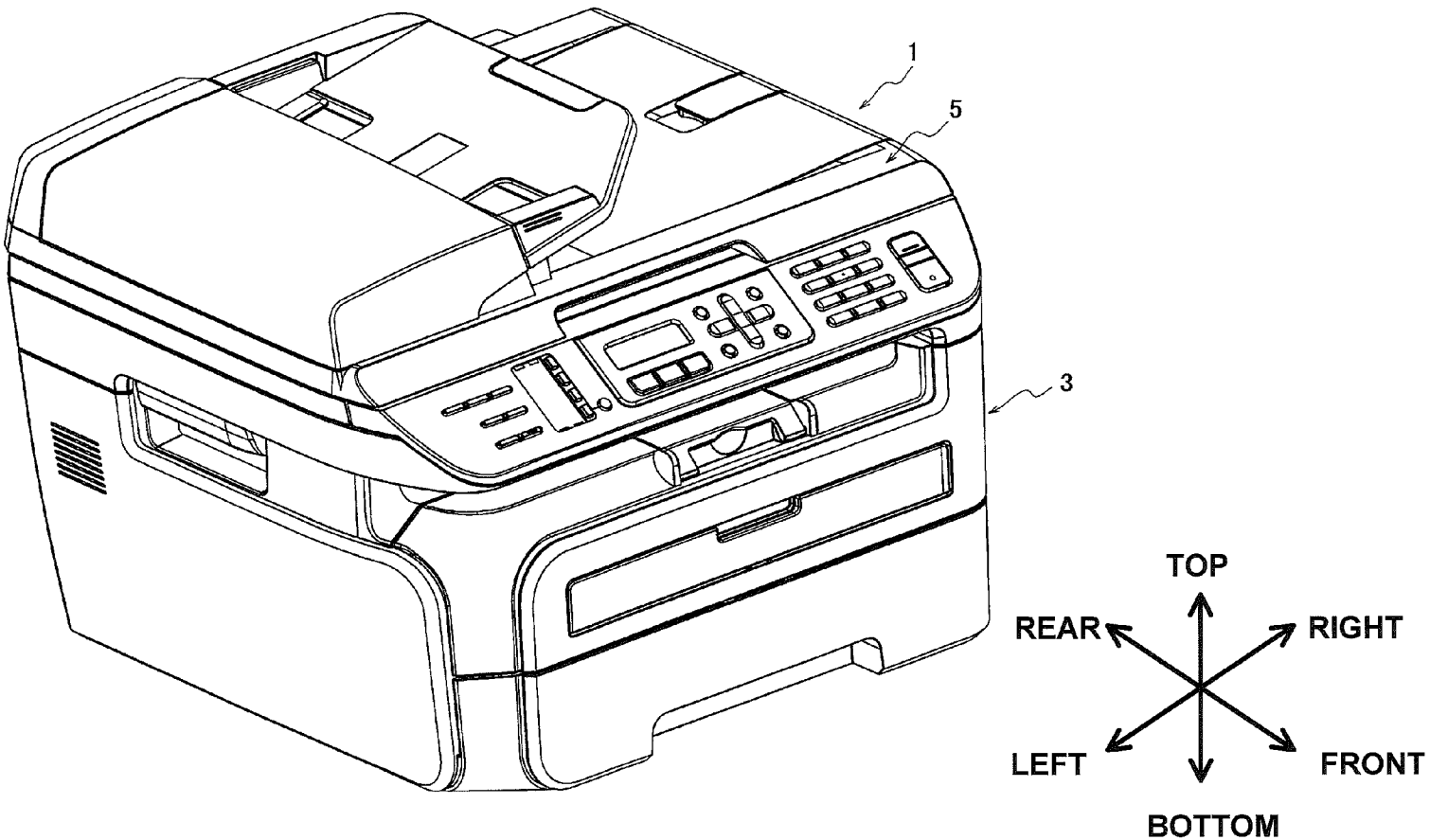
FIG. 1 is a perspective view of a multifunction apparatus viewed from above.

An illustrative embodiment will be described in detail with reference to the accompanying drawings. An image forming apparatus may be a multifunction apparatus 1 where a monochrome printer unit 3 and a flatbed-type scanner unit 5 are combined, as shown in FIG. 1.

For ease of discussion, in the following description, directions are defined as viewed from a user who operates the multifunction apparatus 1. The top or upper side, the bottom or lower side, the left or left side, the right or right side, the front or front side, and the rear or rear side of the multifunction apparatus 1 are identified as indicated by the arrows in FIG. 1. With regard to various individual objects of the multifunction apparatus 1, sides of the individual objects are similarly identified based on the arranged/attached position of the object on/in the multifunction apparatus 1.

Figure 3:
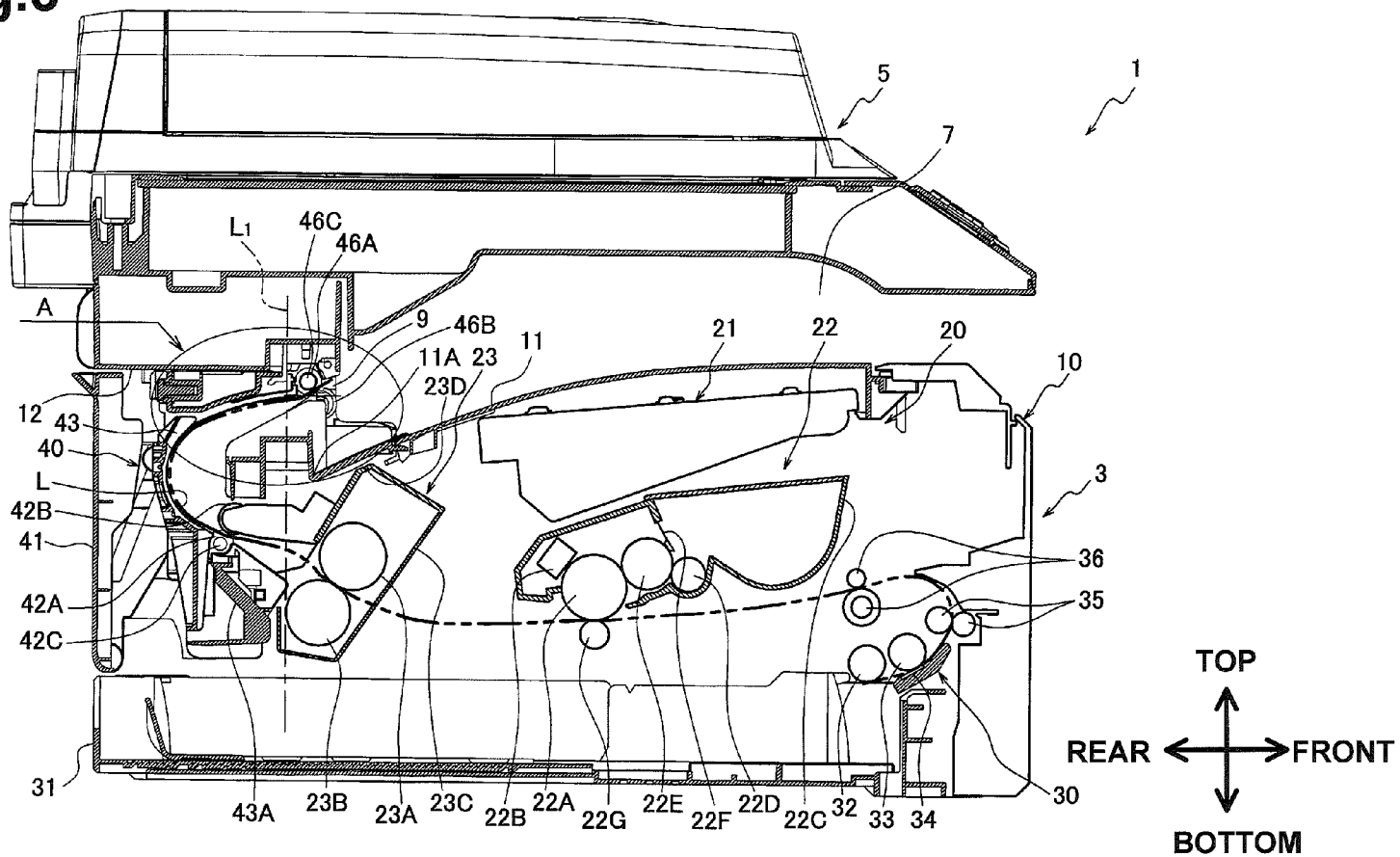
FIG. 3 is a side view of the multifunction apparatus of FIG. 1.

As shown in FIG. 3, the multifunction apparatus 1 may include the printer unit 3, the scanner unit 5 disposed above the printer unit 3, and a sheet ejection portion 7 provided between the printer unit 3 and the scanner unit 5. A recording sheet (hereinafter referred to as a sheet), e.g., a plain, glossy, or transparency sheet, on which an image has been formed or printed in the printer portion, is ejected to the sheet ejection portion 7.

The printer unit 3 may be an electrophotographic image forming apparatus configured to form an image on a sheet by transferring a developer image onto the sheet. The scanner unit 5 may be a flatbed-type image reading apparatus configured to read an image on a document placed at rest.

As shown in FIG. 3, the printer unit 3 may include, in a housing 10, an image forming section 20, a feeder section 30, and a conveyance unit 40. The image forming section 20 may be configured to form an image on a sheet. The feeder portion 30 may be configured to supply a sheet to the image forming section 20. The conveyance unit 40 constitutes a conveyance path L having generally a U-shape, through which a sheet on which an image has been completely formed at the image forming section 20 is conveyed toward an ejection opening 9. By traveling the path, the sheet's orientation may be flipped, e.g., changed by approximately 180 degrees.

An opening 12 may be provided on a rear side of the housing 10 and at a turn-around portion of the conveyance path L, which is a curved portion of the U-shape. Jammed sheets in the conveyance unit 40 or fixing unit 23 can be removed through the opening 12. The opening 12 may be opened and closed by a rear cover 41 pivotally disposed on the rear side of the housing 10.

An ejection tray 11 may be disposed on an upper side of the housing 10 and above the fixing unit 23. The ejection tray 11 may be configured to receive at least a sheet ejected from the ejection opening 9 thereon. The ejection tray 11 may be inclined with respect to a horizontal plane such that it is lower (e.g., closer to the fixing unit 23) at the ejection opening 9. In the FIG. 3 example, a lowermost end position 11A of the ejection tray 11 is lower than an upper end position 23D of the fixing unit 23.

The image forming unit 20 and the conveyance unit 40 may be attached to a frame (not shown), which may be a part of the apparatus body. In the housing 10, the frame may include side frames (not shown) disposed on left and right sides of the housing 10, a bottom frame (not shown) extending in a left-right direction to connect lower ends of the side frames, and a top frame (not shown) connecting upper ends of the side frames.

As shown in FIG. 3, the feeder section 30 may include a sheet supply tray 31, a pickup roller 32, a separation roller 33, a separation pad 34, a pair of conveying rollers 35, and a pair of registration roller 36. The sheet supply tray 20 may be disposed in a bottom portion in the housing 10 in a detachable manner. The pickup roller 32, the separation roller 33, and the separation pad 34 may be disposed above a front side of the sheet supply tray 31. The pickup roller 32 may be configured to supply sheets toward the image forming unit 20. The separation roller 33, and the separation pad 34 may be configured to separate the sheets supplied by the pickup roller 32 one by one. The pair of conveying rollers 35 may be disposed downstream of the separation roller 33 with respect to a direction in which a sheet is conveyed (hereinafter referred to as a sheet conveyance direction), and may be configured to convey the sheet conveyed by the pickup roller 32 toward the image forming unit 20. The pair of registration rollers 36 may be disposed downstream of the conveying rollers 35 and in front of an entrance to the image forming unit 20. The registration rollers 36 may be configured to apply resistance to a sheet being conveyed to correct skewing.

As shown in FIG. 3, the image forming unit 20 may include a light exposure unit 21, a developing unit 22 and the fixing unit 23.

The exposure unit 21 may be disposed in an upper portion in the housing 10, and configured to form an electrostatic latent image on a surface of a photosensitive drum 22A. The exposure unit 21 may mainly include a laser light source (not shown), a polygon mirror (not shown), fθ lenses (not shown), and reflecting mirrors (not shown).

The developing unit 22 may be stored below the light exposure unit 21 in the housing 10 in a detachable manner. The developing unit 22 may include a photosensitive drum 22A, a charger 22B, a developer storing portion 22C, a supply roller 22D, a developing roller 22E, and a layer-thickness regulating blade 22F. The photosensitive drum 22A may be configured to carry thereon a developer to be transferred onto a sheet. The charger 22B may be configured to charge the surface of the photosensitive drum 22A. The developer storing portion 22C may be configured to store a developer, e.g. toner. The supply roller 22D and the developing roller 22E may be disposed between the developer storing portion 22C and the photosensitive drum 22A, and configured to supply the developer from the developer storing portion 22C to the photosensitive drum 22A. The layer-thickness regulating blade 22F may be configured to uniformly regulate the developer carried on the developing roller 22E to a specified thickness as a thin layer.

The developer in the developer storing portion 22C may be supplied toward the developing roller 22E by rotation of the supply roller 22D, and carried on the developing roller 22E. The developer carried on the developing roller 22E may be supplied to the surface of the photosensitive drum 22A, which may then be exposed to light by the light exposure unit 21.

A transfer roller 22G may be disposed facing the photosensitive drum 22A. The transfer roller 22G may be given an electrical charge having a polarity (e.g., a negative electrical charge) opposite a polarity of an electrical charge applied to the photosensitive drum 22A. As the transfer roller 22G rotates in synchronization with the photosensitive drum 22A, the developer image carried on the surface of the photosensitive drum 22A is transferred onto a print side of the sheet passing between the transfer roller 22G and the photosensitive drum 22A.

The fixing unit 23 may be detachably attached to the frame (e.g., may be configured for easy removal). The fixing unit 23 may include a heat roller 23A, a pressure roller 23B, and a casing 23C. The heat roller 23A may be disposed to face the print side of a sheet and may be configured to apply heat to the developer image on the sheet. The pressure roller 23B may be disposed facing the heat roller 23A, and may be configured to press the sheet toward the heat roller 23A. The heat roller 23A and the pressure roller 23B may be stored in the casing 23C.

Figure 5:
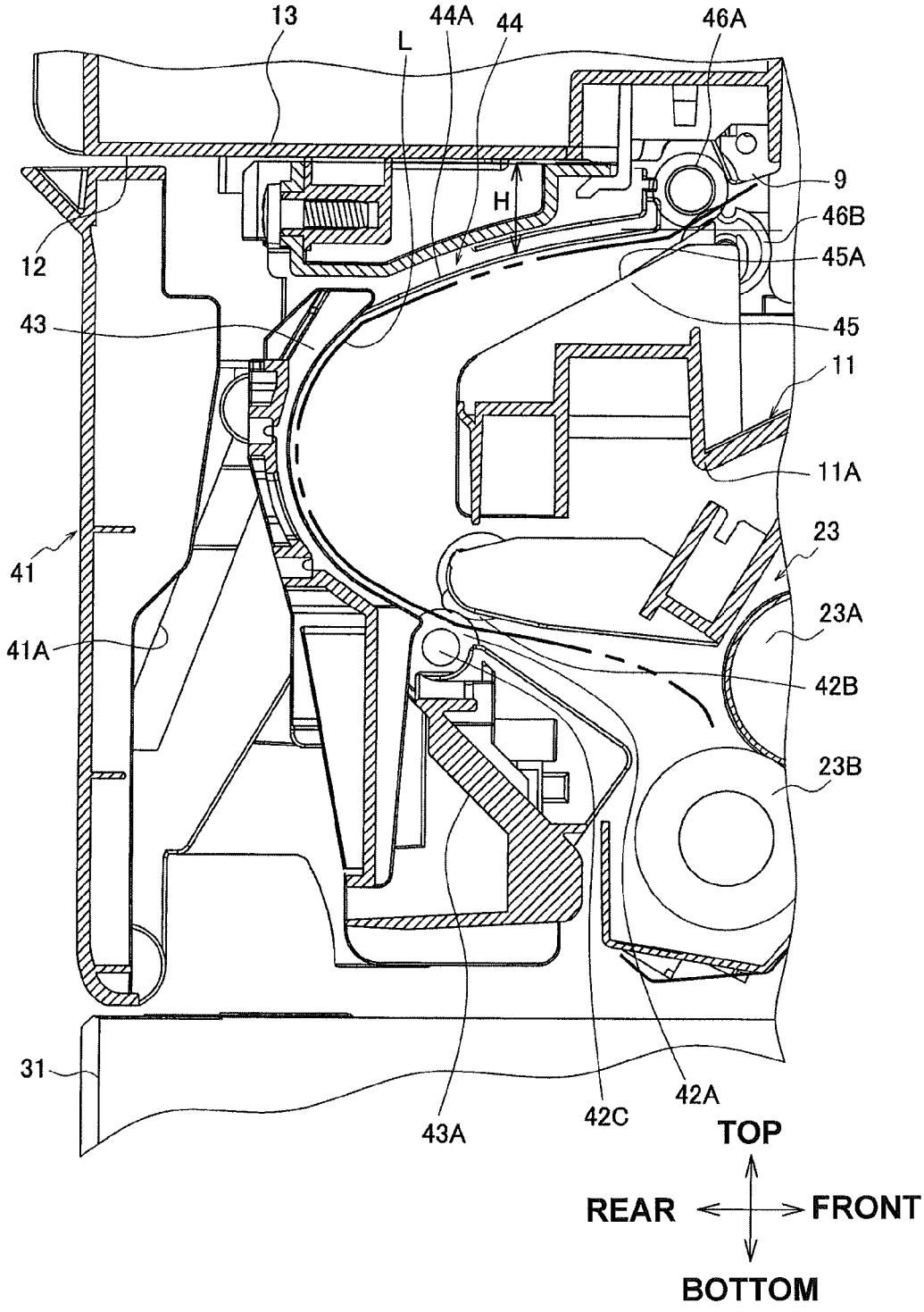
FIG. 5 is an enlarged view of a conveying unit.
Figure 6:
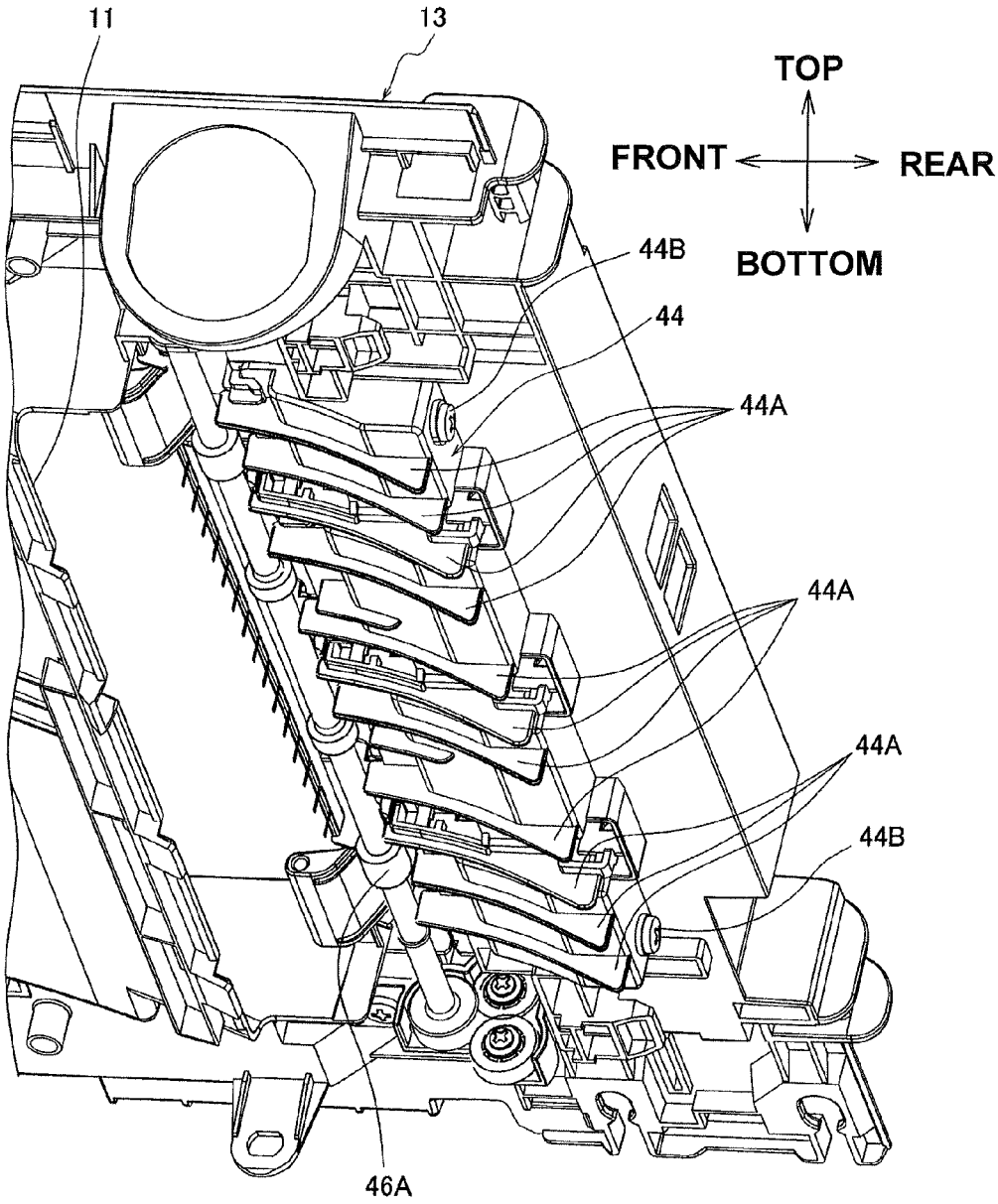
FIG. 6 is a perspective view of a top cover of the printer portion viewed from bottom.

As shown in FIG. 5, the conveyance unit 40 may be disposed downstream of the fixing unit 23 in the sheet conveyance direction, and constitutes the conveyance path L from the fixing unit 23 to the ejection port 9. A sheet ejected from the fixing unit 23 is conveyed to the ejection tray 11 through the conveyance path L. The conveyance unit 40 may be configured from the following elements.

Figure 2:
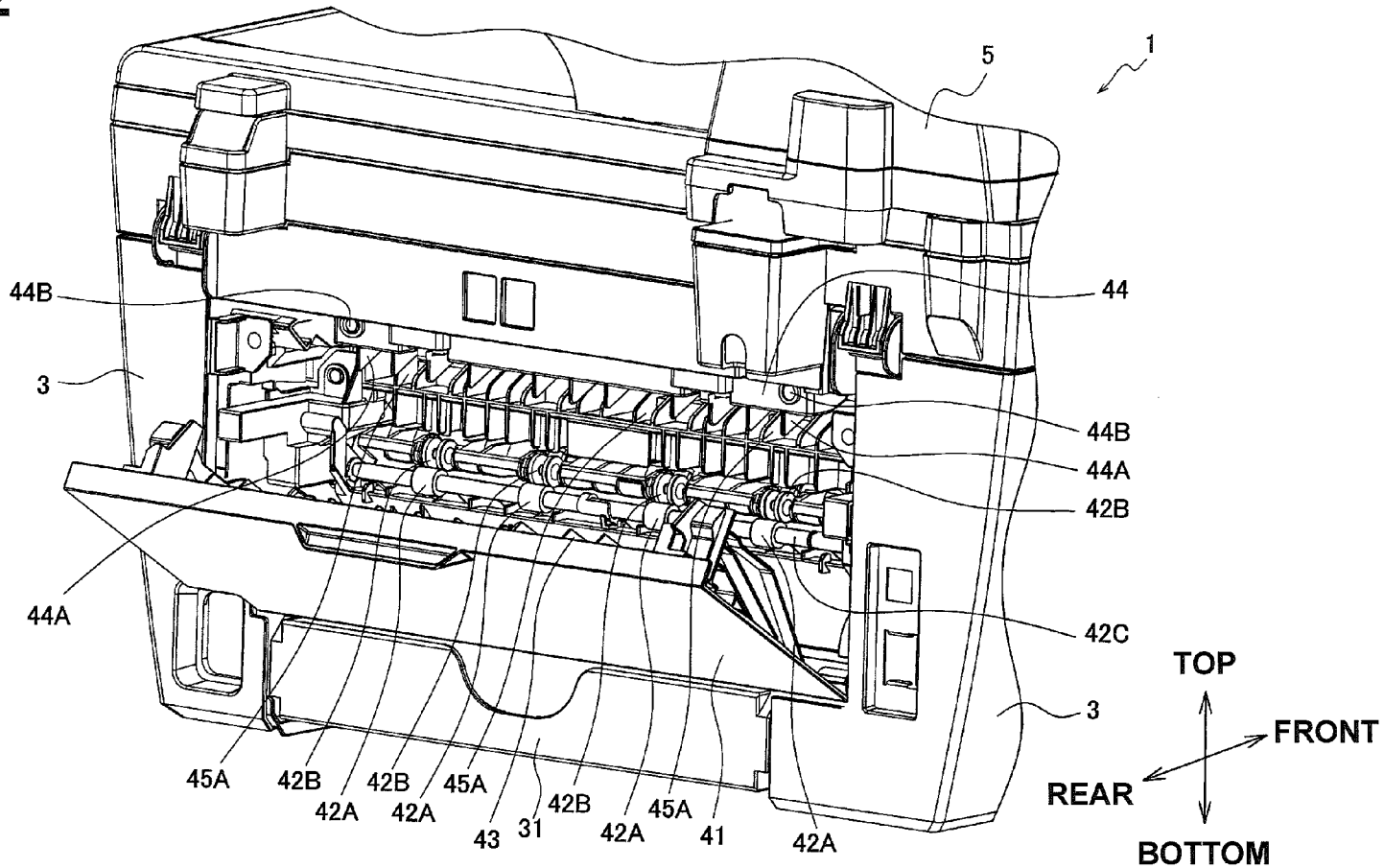
FIG. 2 is a perspective view of the multifunction apparatus of FIG. 1, where a rear cover of the multifunction apparatus is opened.

A pair of conveying rollers 42A, 42B may be configured to convey a sheet ejected from the fixing unit 23 while rotating in contact with the sheet. As illustrated in FIG. 5, a lower conveying roller 42A may be a drive roller configured to apply force to a sheet, and an upper conveying roller 42B may be a driven roller configured to press the sheet toward the drive roller 42A and be rotated by the sheet being conveyed. As shown in FIG. 2, there may be a plurality of pairs of conveying rollers 42A, 42B, spaced at intervals across the width of the sheet.

The drive rollers 42A may be mounted around a shaft 42C, and obtain power from an electric motor via a plurality of gears (not shown) to rotate. The driven rollers 42B may be mounted to the apparatus body so as to move in a direction generally perpendicular to an axial direction of the shaft 42C that drives the drive rollers 42A. Each driven roller 42B may be pressed toward its corresponding drive roller 42A by an elastic member, e.g. a spring (not shown).

As shown in FIG. 5, a turning guide 43 may be disposed downstream of the conveying rollers 42A, 42B in the sheet conveyance direction. The turning guide 43 may be disposed in the turn-around portion of the conveyance path L, and configured to change the conveyance direction of the sheet passing between the conveying rollers 42A, 42B upward by approximately 180 degrees.

The turning guide 43 may be pivotally mounted to a holding member 43A to which the shaft 42C of the drive rollers 42A is mounted. The holding member 43A is pivotally mounted to the frame. With this configuration, as the holding member 43A pivots, the drive rollers 42A shift towards, or away from, driven rollers 42B.

An outer guide 44 and an inner guide 45 may be disposed downstream of the turning guide 43 in the sheet conveyance direction, in other words, downstream of the turn-around portion of the conveyance path L. The outer guide 44 constitutes an outer guiding member in the conveyance path L and the inner guide 44 constitutes an inner guiding member in the conveyance path L.

A pair of ejection rollers 46A, 46B may be disposed on the most downstream side of the conveyance path L, that is, in front of the ejection opening 9. The ejection rollers 46A, 46B may be configured to cause the sheet to be ejected to the ejection tray 11. An upper ejection roller 46A may be configured to contact the print side of the sheet and apply force to the sheet, and a lower ejection roller 46B may be configured to contact the lower side of the sheet, opposite the print side, and press the sheet toward the upper ejection roller 46A, and can be rotated by the sheet being ejected.

As shown in FIG. 3, a rotation center 46C of the upper ejection roller 46A may be positioned further forward than a vertical phantom line L1 that is tangent to an outer surface of the pressure roller 23B. A leading end of the sheet ejected to the ejection tray 11 may be positioned toward the front side of the multifunction apparatus 1.

Figure 4:
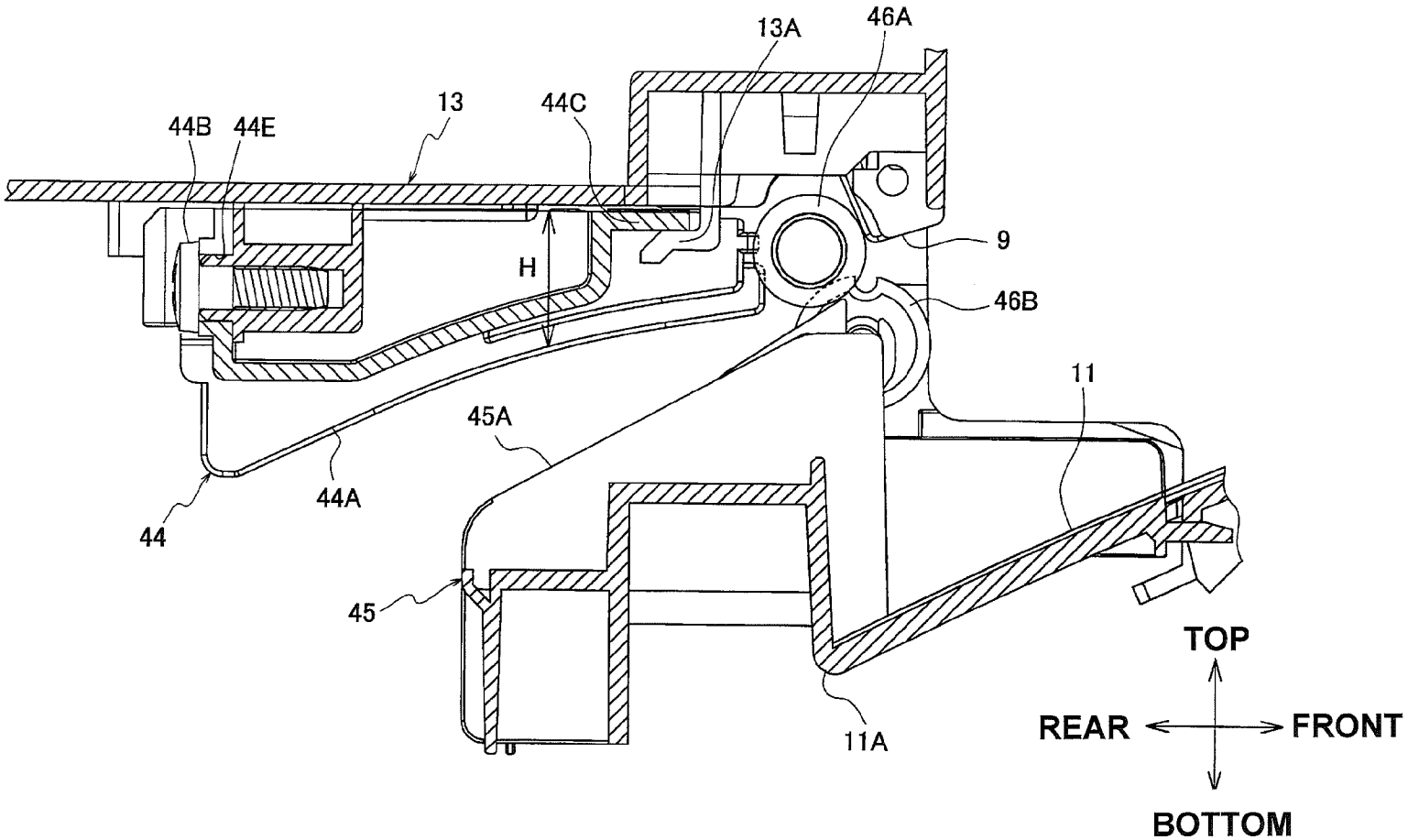
FIG. 4 is an enlarged view of a part A of FIG. 3.
Figure 10:
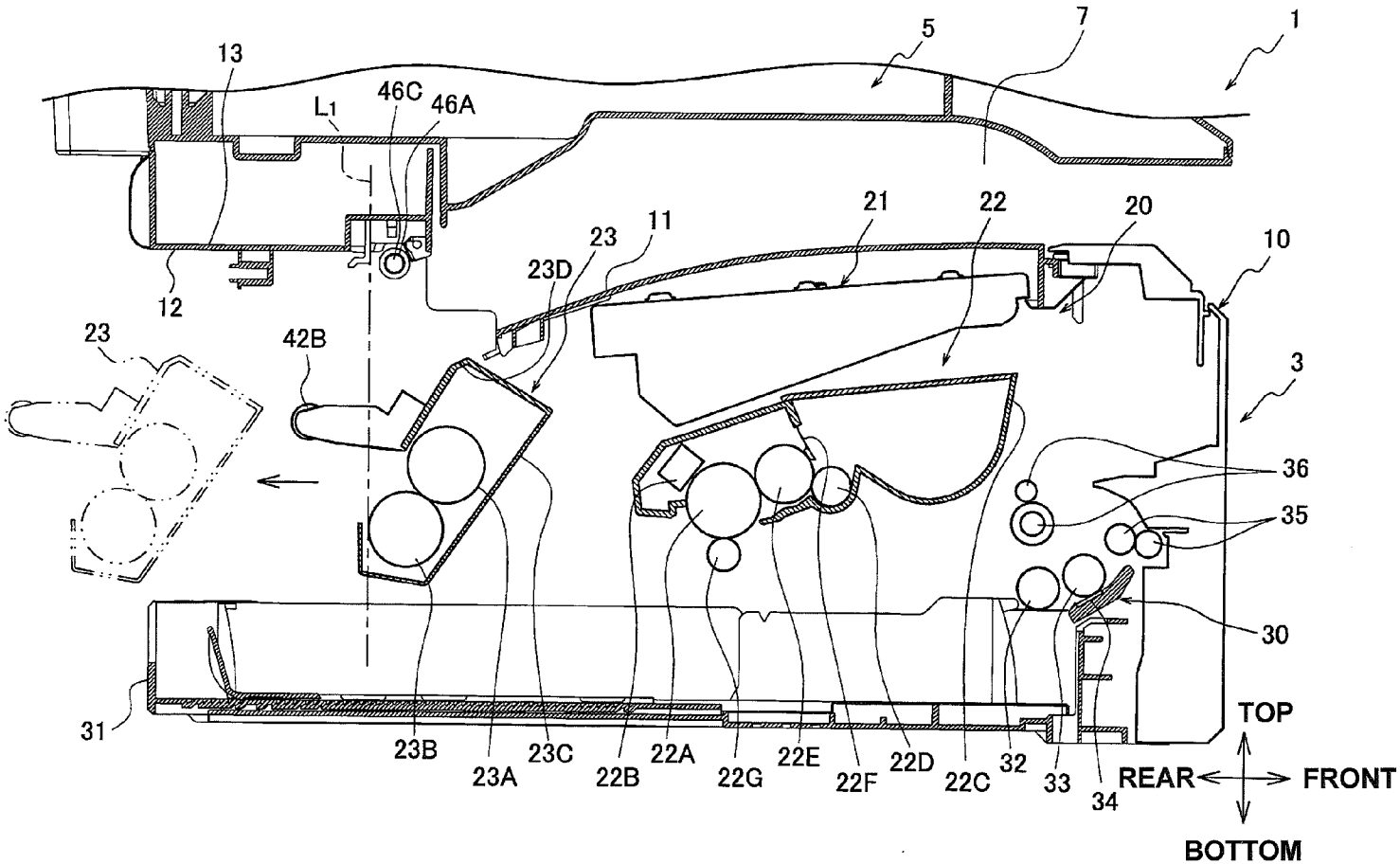
FIG. 10 illustrates an operation procedure for removing a fixing unit.
Figure 11:
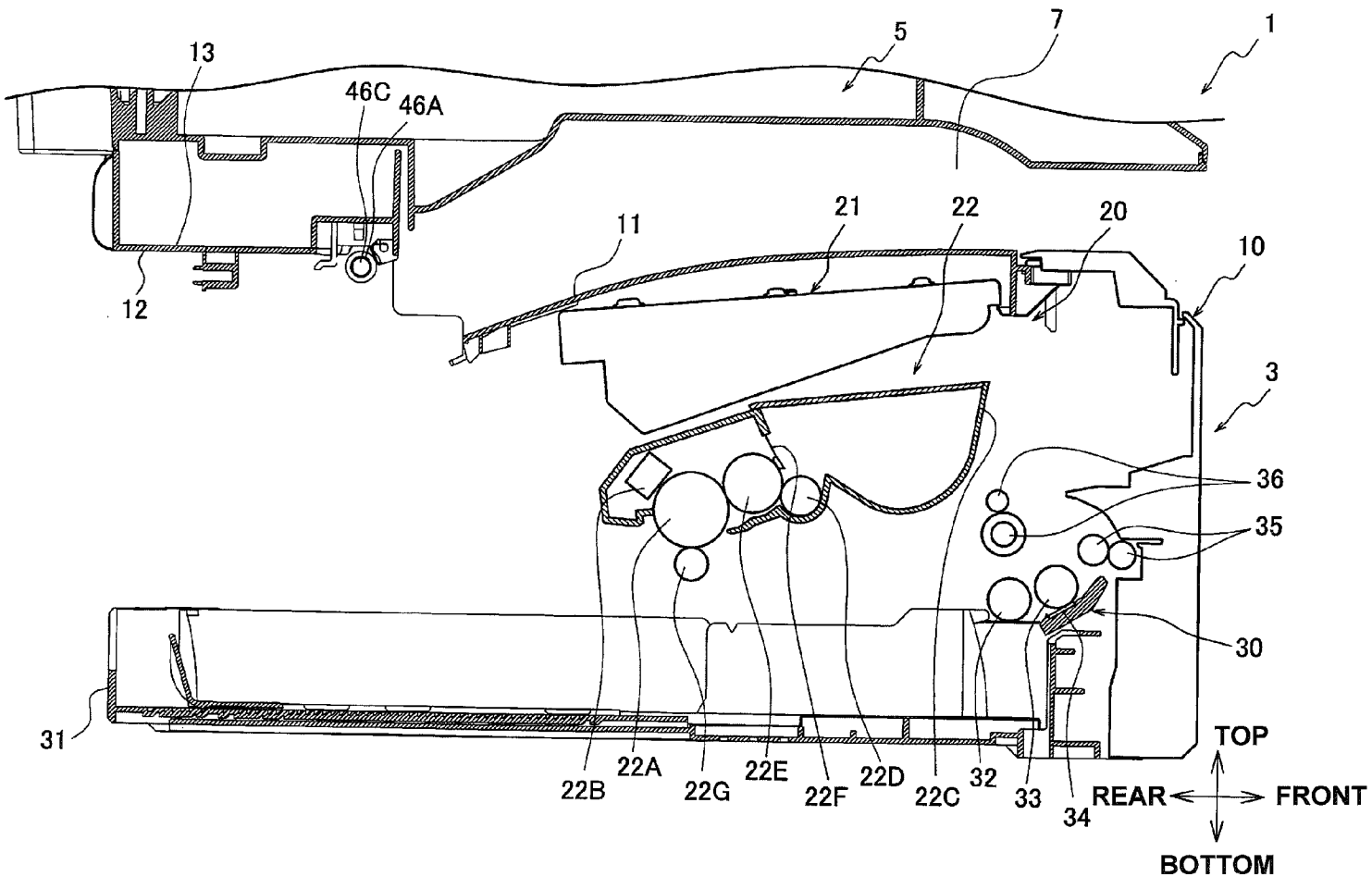
FIG. 11 illustrates an operation procedure for removing the fixing unit.

As shown in FIG. 4, the inner guide 45 may be coupled to the lowermost end position 11A of the ejection tray 11, and may be configured to be attached to, and removed from, the ejection tray 11 that is a part of the housing 10 (See FIG. 10, showing inner guide 45 removed). The inner guide 45 may be provided with inner guiding portions 45A. The inner guide 45 may be inclined such that a distance between the inner and outer guides is smaller near the ejection opening than it is at the turnaround portion of the conveyance path L.

The outer guide 44 may be attached to a top cover 13 forming a part of frame defining an upper end of the opening 12 in a detachable manner (e.g., so that it is easily removed).

For example, the outer guide 44 may be provided, close to the ejection roller 46A, with an engaging portion 44C, which may be stopped in an engaged state with a hook 13A provided in the top cover 13. Screws 44B may be inserted into the outer guide 44 from the rear side toward the front side, and fixed to hold the outer guide 44 to the top cover 13.

When the screws 44B are removed, the outer guide 44 may be moved horizontally toward the rear (toward the opening 12), so that the outer guide 44 can be easily removed from the top cover 13.

Figure 7:
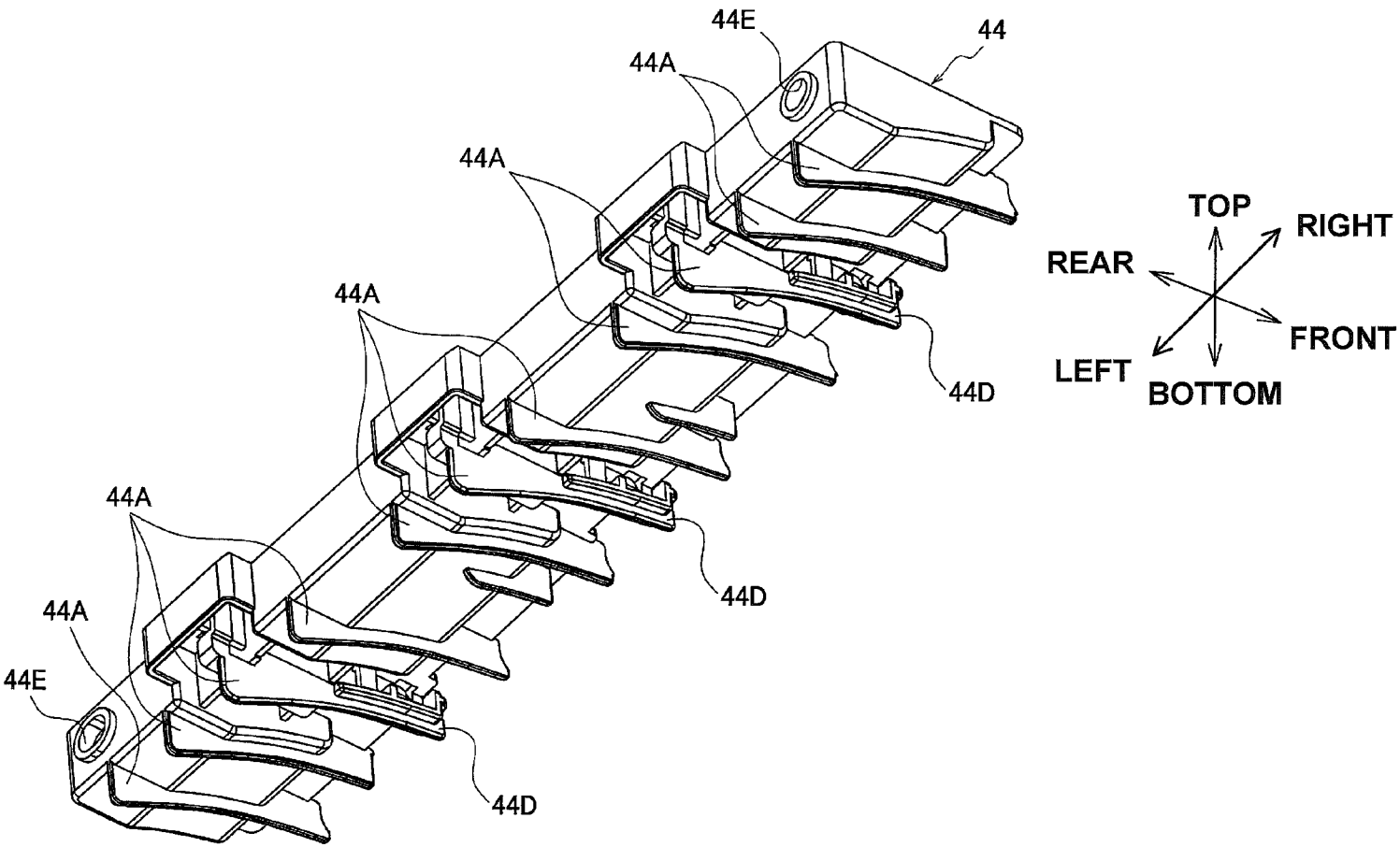
FIG. 7 is a perspective view of an outer guide when viewed from an outer guiding portion.

As illustrated, screw holes 44E (FIG. 7) for inserting the corresponding screws 44B therein, and the engaging portion 44C, may be disposed at least on a one-by-one basis on opposing sides of the outer guide 44 in a longitudinal direction (i.e., a left-right direction illustrated in FIG. 7).

The top cover 13 may constitute a top wall portion of the housing 10 covering an upper surface of the outer guide 44. The top cover 13 may also function as a joint member connecting the printer unit 3 and the scanner unit 5.

The outer guide 44 may be provided with outer guiding portions 44A disposed facing the inner guide 45. The outer guiding portions 44A may extend in the front-to-rear direction (as shown in FIG. 7) from the opening 12 side toward the ejection rollers 46A, 46B, to guide a sheet toward the ejection rollers 46A, 46B.

As shown in FIG. 4, the outer guiding portions 44A may protrude downward from the top cover 13 so as to cover the inner guide 45 from the rear. As shown in FIG. 7, the outer guiding portions 44A may be ribs protruding downward and extending from the rear toward the front and overlapping each other in the left-right direction.

Lower ends of the outer guiding portions 44A may be inclined relative to a horizontal direction such that their protruding dimension (H, in FIGS. 4 and 5) from the top cover 13 increases from the front side (e.g., the ejection rollers 46A, 46B) toward the rear (e.g., the opening 12). The protruding dimension (H) of each outer guiding portion 44A may be measured with reference to a surface on which the outer guide 44 and the top cover 13 are attached to each other.

As shown in FIG. 5, the outer guide 44 may be positioned further toward the rear (e.g., closer to the opening 12) than the inner guide 45 is. When viewed from the rear side in FIG. 5, the outer guide 44 overlaps at least part of the inner guide 45. Thus, as illustrated in FIG. 5, the outer guide 44 obstructs the removal of the inner guide 45 from the housing 10.

Thus, as illustrated in FIG. 5, the outer guide 44 may first be removed from the housing 10, and then the inner guide 45 may be removed, and then the fixing unit 23 can be removed from the housing 10.

As illustrated in FIG. 7, the outer guide 44 includes a plurality of, e.g., eleven, outer guiding portions 44A. Some of the outer guiding portions 44A, e.g., three outer guiding portions 44D, may be made of a material having higher wear resistance than the outer guiding portions 44A, e.g., Polyacetal (POM).

The outer guiding portions 44A may be integrally formed with the outer guide 44, while the outer guiding portions 44D may be manufactured separately from the outer guide 44 and then fixed to the outer guide 44.

As shown in FIG. 5, the rear cover 41 may be removably and pivotally attached to the housing 10, and may include a guide groove 41A, which may be an elongated opening in which a guide pin (not shown) of the turning guide 43 may be slidably inserted. When the rear cover 41 is opened, the turning guide 43 may be moved in connection with the rear cover 41 so that the turn-around portion of the conveyance path L is released.

The following describes how the inner guide 45 and the fixing unit 23 may be attached to, or removed from, the housing 10 with reference to FIGS. 8-11.

In the multifunction apparatus 1, the outer guide 44 may first be removed, and then the inner guide 45 may be removed, with the fixing unit 23 being removed after the inner and outer guides 44 and 45 are removed.

Figure 8:
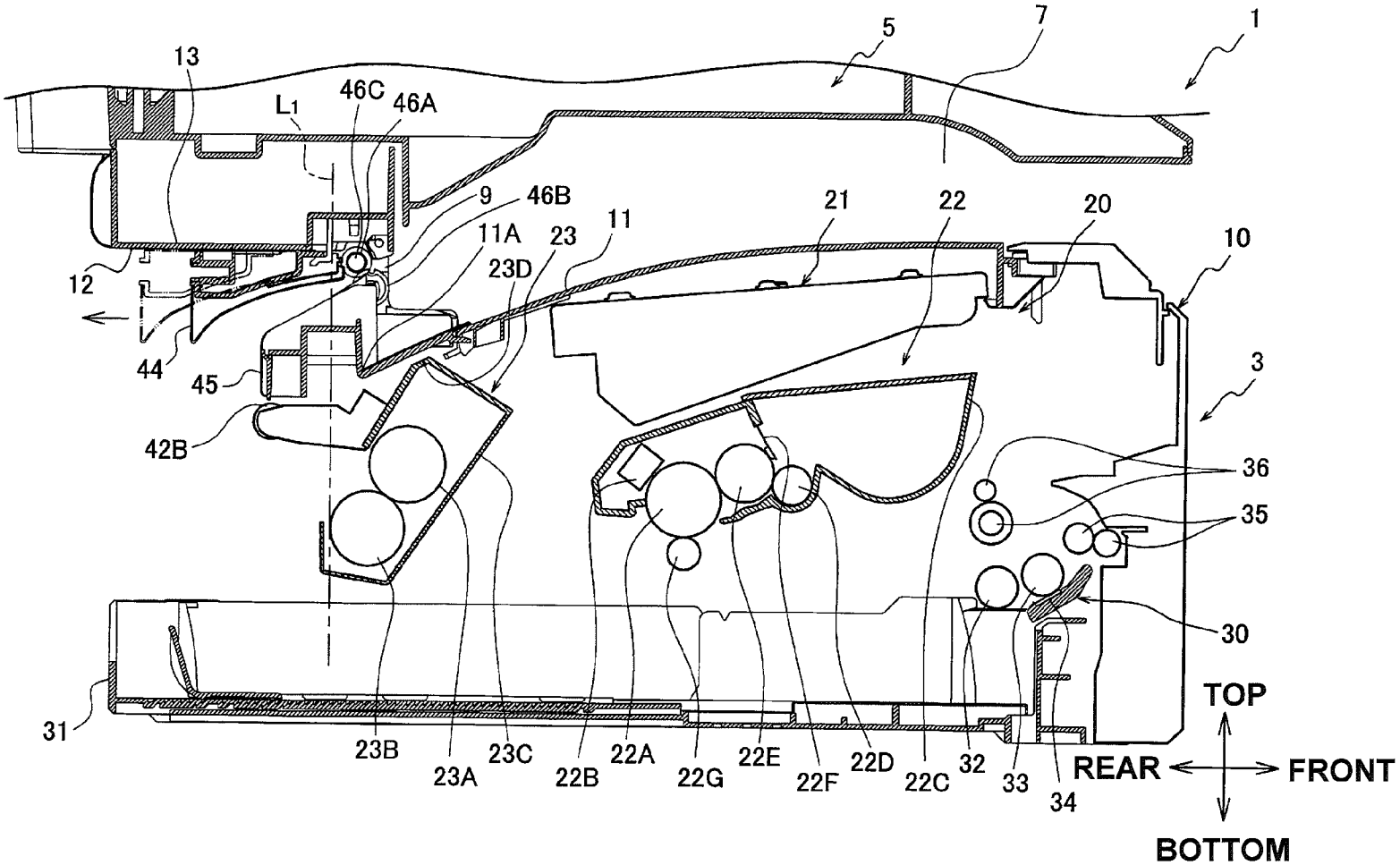
FIG. 8 illustrates an operation procedure for removing an outer guiding portion.

To remove the fixing unit 23, the rear cover 41 may be opened or removed from the housing 10, the screws 44B are unscrewed, and then the outer guide 44 is removed from the top cover 13 by moving the outer guide 44 toward the opening 12 as shown in a phantom line of FIG. 8.

Figure 9:
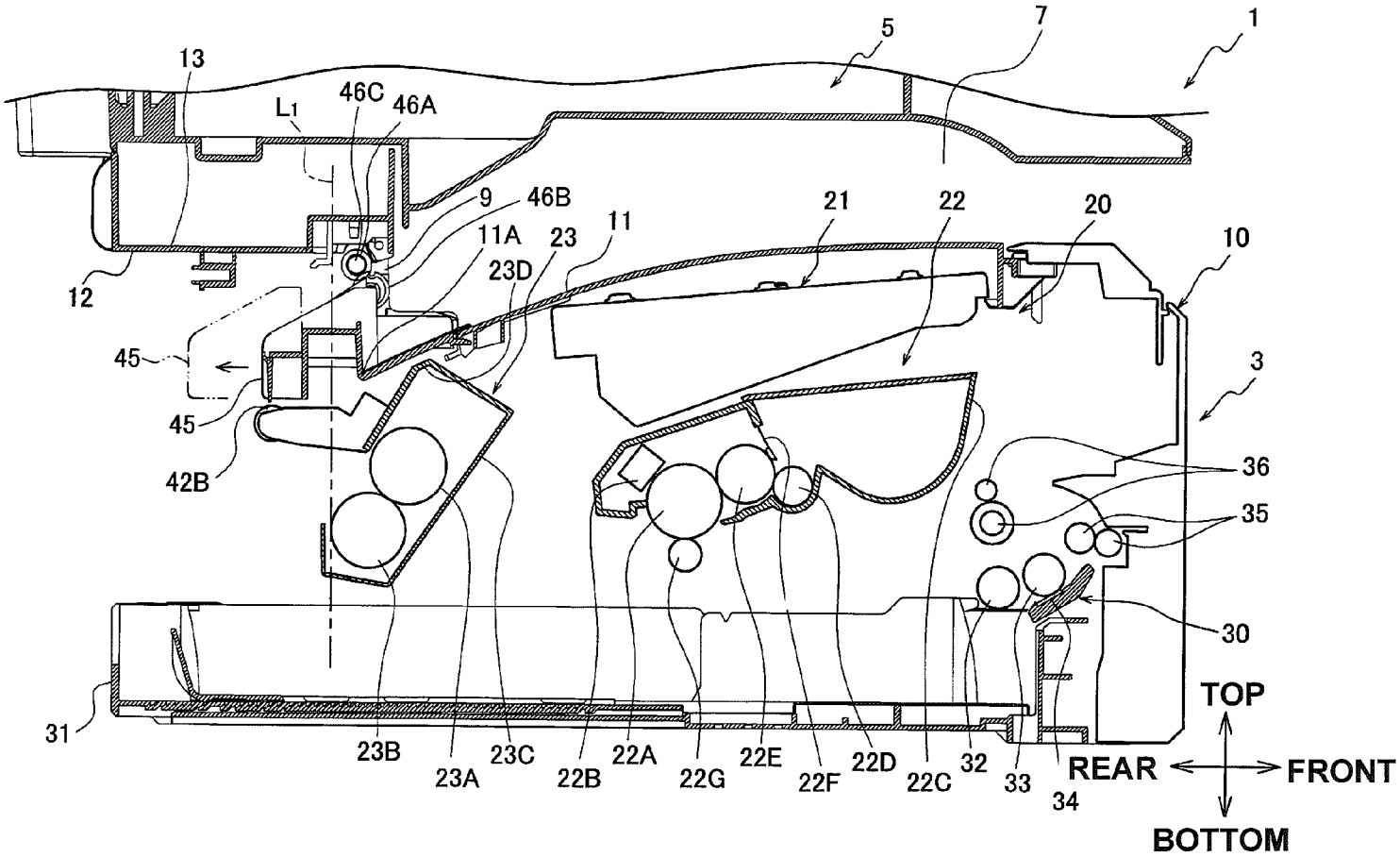
FIG. 9 illustrates an operation procedure for removing an inner guiding portion.

As shown in a phantom line of FIG. 9, the inner guide 45 may be removed from the ejection tray 11 by moving the inner guide 45 toward the opening 12, and then the fixing unit 23 may be removed from the housing 10 by moving the fixing unit 23 toward the opening 12 as shown in a phantom line of FIG. 10.

To attach the fixing unit 23 to the housing 10, the above removal procedure may be reversed. Specifically, the fixing unit 23, the inner guide 45, and the outer guide 44 may be sequentially installed in the housing 10 in this order, and then the rear cover 41 may be closed or attached to the housing 10.

As illustrated, the outer guide 44 may be attached to the top cover 13 in a detachable manner. After the outer guide 44 is removed from the housing 10, the inner guide 45 can be easily removed from the housing 10 regardless of interference with the outer guide 44. Thus, the workability of attaching and removing the inner guide 45 and the fixing unit 23 can be improved.

The greater the distance between the turn-around portion of the conveyance path L curved in a U-shape and the ejection opening 9, the greater the area where the inner guide 45 and the outer guide 44 face each other. Thus, when the inner guide 45 is attached to or removed from the housing 10, guiding surfaces of both the inner guide 45 and the outer guide 44 risk being damaged.

As illustrated in FIG. 8, the rotation center 46C of the ejection roller 46A configured to contact the upper surface of a sheet is positioned further forward than the phantom line L1, which increases the area where the inner guide 45 and the outer guide 44 face each other. Thus, when the inner guide 45 is attached to or removed from the housing 10, the guiding surfaces of both the inner guide 45 and the outer guide 44 risk being damaged.

This risk of damage may be reduced in the FIG. 5 configuration.

In FIG. 5, as the screws 44B for fixing the outer guide 44 are inserted from the rear of the multifunction apparatus 1, all necessary operations required for the attaching and removing of the outer guide 44 can be performed in the same direction. Thus, the workability of the attaching and removing of the inner guide 45 and the fixing unit 23 can be improved.

Features described herein may be applied to, but are not limited to, the multifunction apparatus 1 combining the printer unit 3 and the scanner unit 5. For example, the features may be applied to an image forming apparatus as a discrete apparatus such as a monochrome or color printer, or an image forming apparatus using LED as a light source of the exposure unit 21.

As described above, the outer guide 44 is attached to the top cover 13. However, this is not required. The outer guide 44 may be attached to any portion other than the top cover 13, and may form a part of a frame defining the opening 12 therein.

As described above, the inner guide 45 is attached to the housing 10. However, this attachment may be made in a variety of ways. The inner guide 45 may be a separate unit that can be attached to or removed from the fixing unit 23, or it may be integrally formed with the fixing unit 23.

Figure 12:
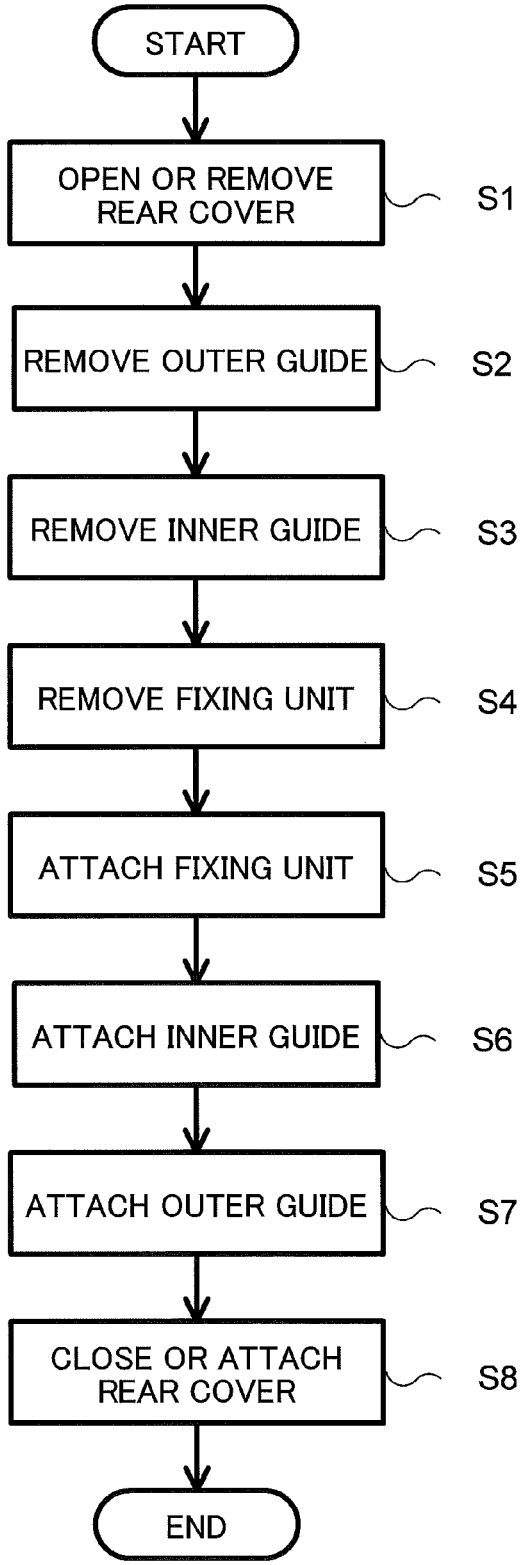
FIG. 12 is a flowchart of attaching and removing the fixing unit.

A procedure of and attaching removing the fixing unit 23 will be described with reference to FIG. 12.

To remove the fixing unit 23, the rear cover 41 may be opened or removed from the housing 10 (S1). Next, the outer guide 44 may be removed (S2). Then, the inner guide 45 may be removed (S3). Finally, the fixing unit 23 may be removed (S4). To attach the fixing unit 23 to the housing 10, the above removal procedure may be reversed. Specifically, the fixing unit 23 may be attached to the housing 10 (S5). Next, the inner guide 45 may be attached to the housing 10 (S6). Then, the outer guide 44 may be attached to the housing 10 (S7). Finally, the rear cover 41 may be closed or attached to the housing 10 (S8).

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body having an opening covered by a movable cover;

a fixing unit configured to fix a developer image on a recording sheet, the fixing unit being configured to be attached to and removed from the main body through the opening;

an inner guide configured to be attached to and removed from the main body through the opening; and an outer guide configured to be attached to and removed from the main body through the opening, the inner guide and the outer guide defining a part of a generally U-shaped conveyance path, the inner guide and the outer guide disposed opposite to each other with respect to the generally U-shaped conveyance path, wherein the outer guide is not mounted on the cover;

wherein the inner guide is located on an inner side of a U shape in the U-shaped conveyance path, while the outer guide is located on an outer side of the U shape in the U-shaped conveyance path;

wherein the outer guide is disposed closer to the opening than the inner guide, and overlaps, when viewed from the opening, a sheet guide surface located on a downstream portion of the inner guide with respect to the U-shaped conveyance path and adjacent to an ejection end of the conveyance path; and wherein, when the outer guide is removed from the main body, the inner guide is exposed to the opening from an upstream portion of the inner guide with respect to the generally U-shaped conveyance path to the sheet guide surface located on the downstream portion of the inner guide and adjacent to the ejection end of the conveyance path.

2. The image forming apparatus according to claim 1, wherein the inner guide is disposed closer to the opening than the fixing unit, and overlaps at least a part of the fixing unit viewed from the opening.

3. The image forming apparatus according to claim 1, wherein the outer guide is disposed on a downstream side of the generally U-shaped conveyance path.

4. The image forming apparatus according to claim 1, further comprising a screw fastening the outer guide to the main body, wherein a head of the screw faces toward the opening.

5. The image forming apparatus according to claim 1, wherein the fixing unit, the inner guide, and the outer guide are disposed within a height of the cover.

6. The image forming apparatus according to claim 1, wherein the cover is configured to rotate about an axis between an opening position and a closing position, wherein the cover covers the opening when in the closing position.

7. The image forming apparatus according to claim 1, further comprising a flatbed-type image reading unit disposed above a sheet ejection tray and configured to read an image of a document placed thereon at rest.

8. The image forming apparatus of claim 1, wherein the fixing unit further includes a pair of opposing rollers located towards the rear of the main body, and the apparatus further comprising:

a pair of ejection rollers disposed on a downstream end of the conveyance path, wherein one of the ejection rollers is positioned to have a rotation center that is further forward in the main body than a rear-most outer surface of one of the fixing unit rollers.

9. The image forming apparatus of claim 8, wherein the fixing unit pair of opposing rollers includes an upper roller and a lower roller, wherein the pair of ejection rollers includes an upper ejection roller and a lower ejection roller, and wherein a rotation center of the upper ejection roller is further forward in the main body than a rear-most outer surface of the lower fixing unit roller.

10. A method of removing a fixing unit out of a main body of an image forming apparatus, the image forming apparatus comprising a main body having an opening, a fixing unit, an inner guide, and an outer guide, the inner guide and the outer guide defining a part of a generally U-shaped conveyance path, the method comprising:

opening a cover to expose the opening, wherein the outer guide remains in position as the cover is opened;

exposing a sheet guide portion of the inner guide that is adjacent to an ejection end of the conveyance path to the opening by removing the outer guide out of the main body;

removing the inner guide out of the main body after removing the outer guide; and removing the fixing unit out of the main body after removing the inner guide.

* * * * *